US009888825B2

(12) United States Patent
Tsai

(10) Patent No.: US 9,888,825 B2
(45) Date of Patent: Feb. 13, 2018

(54) POSITIONING STRUCTURE

(71) Applicant: Dikai International Enterprise Co., Ltd., Taoyuan Dist., Taoyuan (TW)

(72) Inventor: Chen-Chou Tsai, Taoyuan (TW)

(73) Assignee: Dikai International Enterprise Co., Ltd., Taoyuan (TW)

( * ) Notice: Subject to any disclaimer, the term of this patent is extended or adjusted under 35 U.S.C. 154(b) by 0 days.

(21) Appl. No.: 15/197,738

(22) Filed: Jun. 29, 2016

(65) Prior Publication Data

US 2018/0000310 A1 Jan. 4, 2018

(51) Int. Cl.

| | |
|---|---|
| ***F16M 13/00*** | (2006.01) |
| ***A47L 13/50*** | (2006.01) |
| ***A47L 13/20*** | (2006.01) |
| ***F16M 13/02*** | (2006.01) |
| ***F16M 11/08*** | (2006.01) |
| ***F16M 11/04*** | (2006.01) |

(52) U.S. Cl.

CPC ..... *A47L 13/50* (2013.01); *A47L 13/20* (2013.01); *F16M 11/046* (2013.01); *F16M 11/08* (2013.01); *F16M 13/02* (2013.01)

(58) Field of Classification Search

CPC .. F16M 2200/08; F16M 13/00; F16M 11/041; F16M 11/10; F16M 11/22; F16M 13/02; F16M 13/022; F16M 11/24; F16M 11/08; F16M 11/00; F16M 5/00; F16M 11/38; F16M 11/14; F16M 11/2014; F16M 11/42; F16M 11/18; F16M 7/00; F16M 11/2021; F16M 11/046; F16M 11/28; F16M 2200/024; F16M 11/105; F16M 2200/02; F16M 13/04; F16M 11/2092; F16M 2200/022; F16M 11/04; F16M 11/12; F16M 2200/028

USPC ..... 248/346.01, 346.03, 346.07, 346.5, 907, 248/161, 407–411, 188.2, 188.5

See application file for complete search history.

(56) References Cited

U.S. PATENT DOCUMENTS

| | | | | |
|---|---|---|---|---|
| 5,492,430 | A * | 2/1996 | Jones | F16B 7/149 248/188.5 |
| 6,817,582 | B2 * | 11/2004 | Wang | B64F 1/16 248/188.5 |
| 6,918,564 | B2 * | 7/2005 | Yen | F16M 11/28 248/123.11 |
| 2014/0061419 | A1 * | 3/2014 | Wehage | B62J 1/06 248/404 |

* cited by examiner

*Primary Examiner* — Steven Marsh

(57) ABSTRACT

A positioning structure includes a locating member, a movable mechanism mounted in the locating member for the connection of a mop and movable up and down relative to the locating member, and a positioning mechanism mounted in the locating member for stopping against the positioning mechanism upon connection of a mop to the movable mechanism to support the mop stably in position for dehydration through a spining action after movement of the movable mechanism to the top side of the locating member.

6 Claims, 10 Drawing Sheets

POSITIONING STRUCTURE

BACKGROUND OF THE INVENTION

1. Field of the Invention

The present invention relates to cleaning tool technology and more particularly, to a positioning structure used in a dehydration bucket for holding a mop, enabling the head of the mop to be stably rotated and dehydrated.

2. Description of the Related Art

Many dehydration buckets are known for dehydrating a mop. In order to save space, the internal pivoting basket in a dehydration bucket is liftable along a track. However, when the user moves the mop up and down in the dehydration bucket, the pivoting basket can lose its position, affecting performance on dehydration.

SUMMARY OF THE INVENTION

The present invention has been accomplished under the circumstances in view. It is therefore the main object of the present invention to provide a positioning structure consisting of a locating member, a movable mechanism and a positioning mechanism and adapted for use in a dehyration bucket for the dehydration of a mop, which enables the mop to abut against the abutment member of the positioning mechanism and to further force the actuation members of the positioning mechanism apart upon connection of the mop to the movable mechanism, so that the protruding portions of the actuation members can be forced into engagement with the respective retaining holes of the locating member, and thus, the mop is stably supported in position for dehydration through a spinning action.

Further, the locating member comprises a displacement chamber and a plurality of retaining holes disposed in communication with the displacement chamber. The movable mechanism is mounted in the displacement chamber, comprising a sliding member and a position-limiting member. The position-limiting member is connected to the top side of the sliding member. The positioning mechanism comprises an abutment member and two actuation members. The abutment member comprises two abutment portions bilaterally disposed at a top side thereof, two guide portions bilaterally disposed at an opposing bottom side thereof and two guide grooves located on a bottom wall thereof. Further, each actuation member comprises a body, a resilient arm upwardly extended from the body, and a protruding portion perpendicularly extended from an opposing bottom end of the body. The abutment member is mounted in the position-limiting member of the movable mechanism with the abutment portions respectively extended out of the position-limiting member. The body of each actuation member is pivotally connected to the sliding member. The resilient arms of the two actuation members are disposed below the guide portion of the abutment member such that the abutment portion of the abutment member is received inside the position-limiting member and the protruding portions of the actuation members are respectively engaged into the respective retaining holes of the locating member.

DETAILED DESCRIPTION OF THE PREFERRED EMBODIMENT

Figure 1:
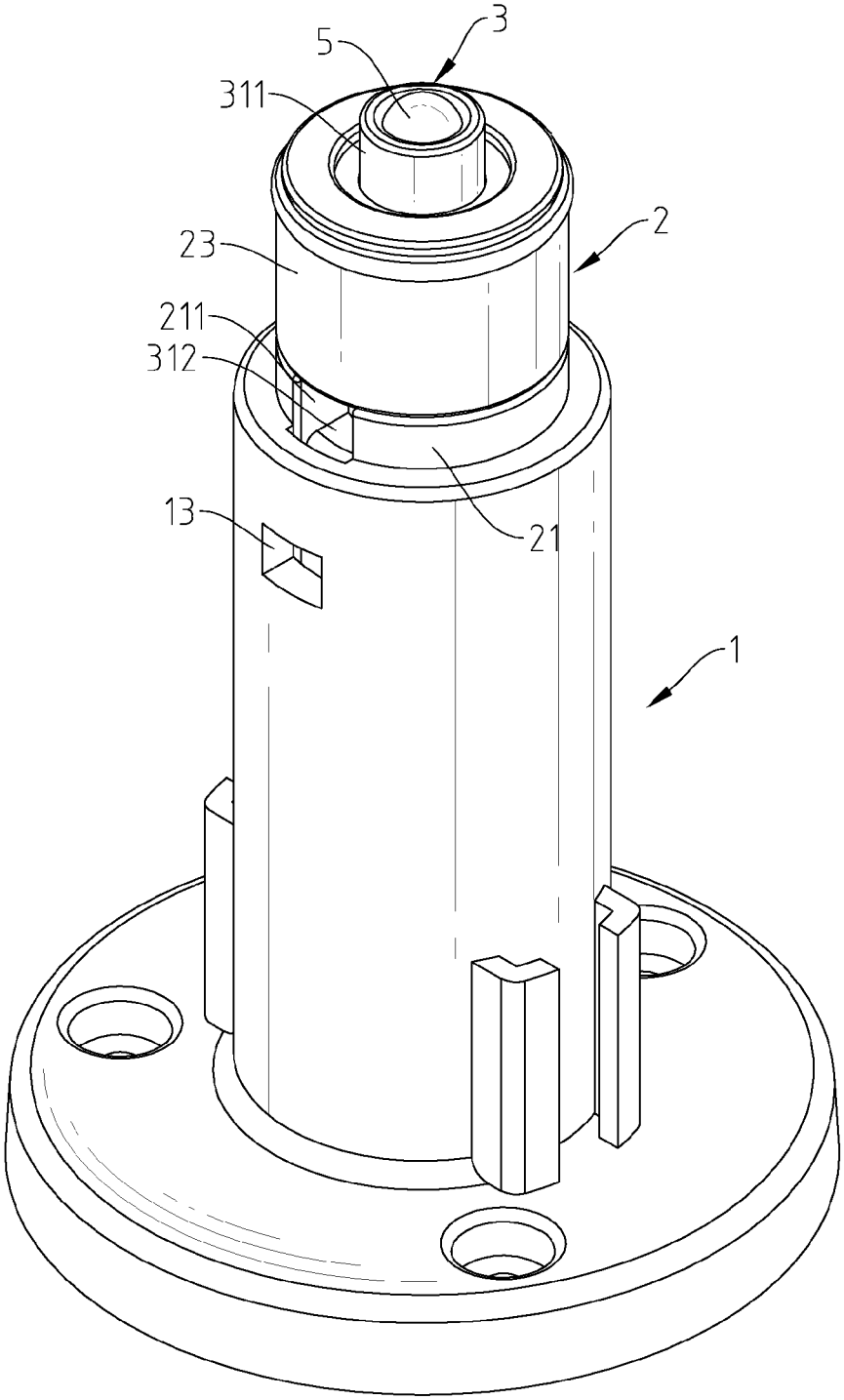
FIG. 1 is an oblique top elevational view of a positioning structure in accordance with the present invention.
Figure 2:
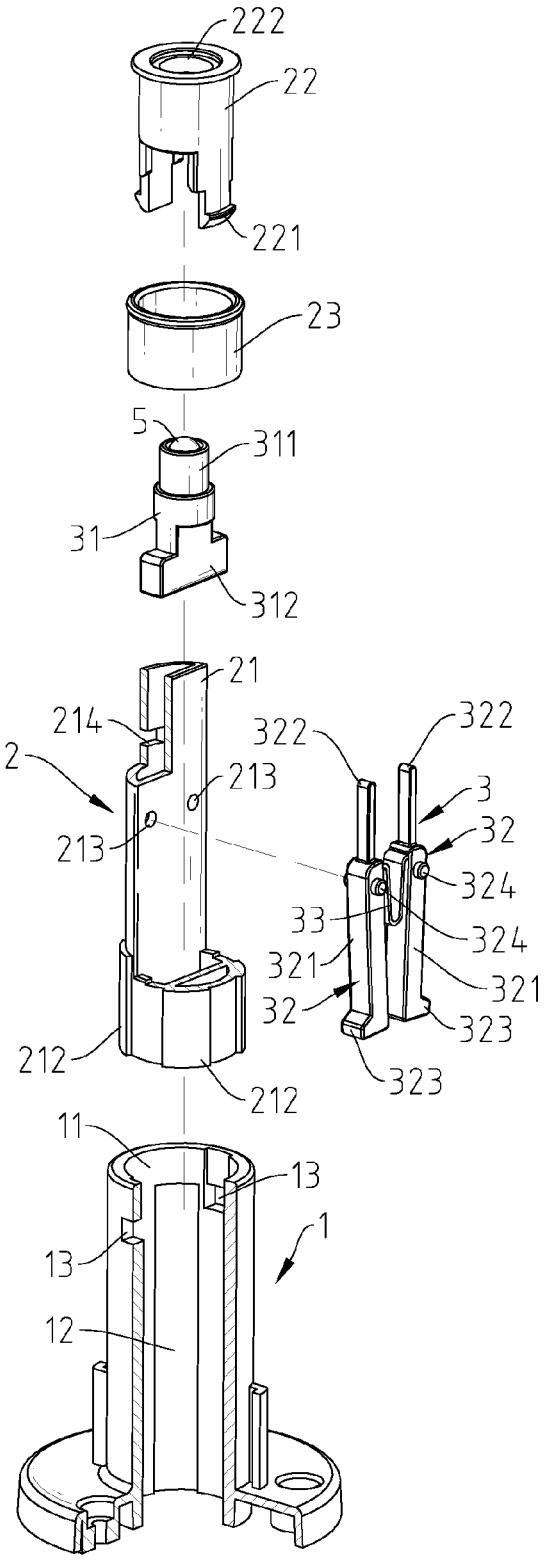
FIG. 2 is an exploded view, partially in sectional elevation, of the positioning structure in accordance with the present invention.
Figure 3:
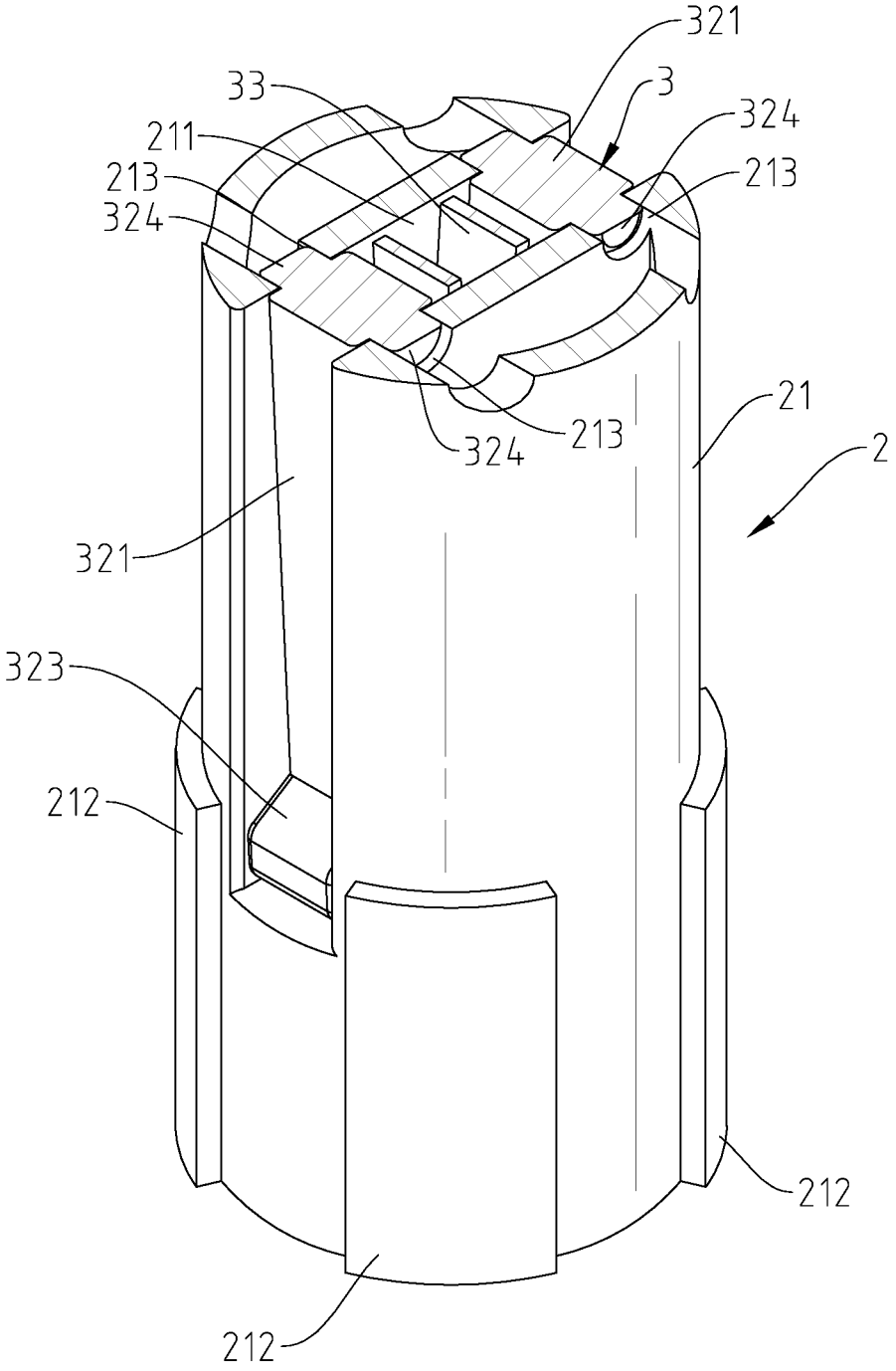
FIG. 3 is a sectional elevational view of a part of the positioning structure in accordance with the present invention.
Figure 4:
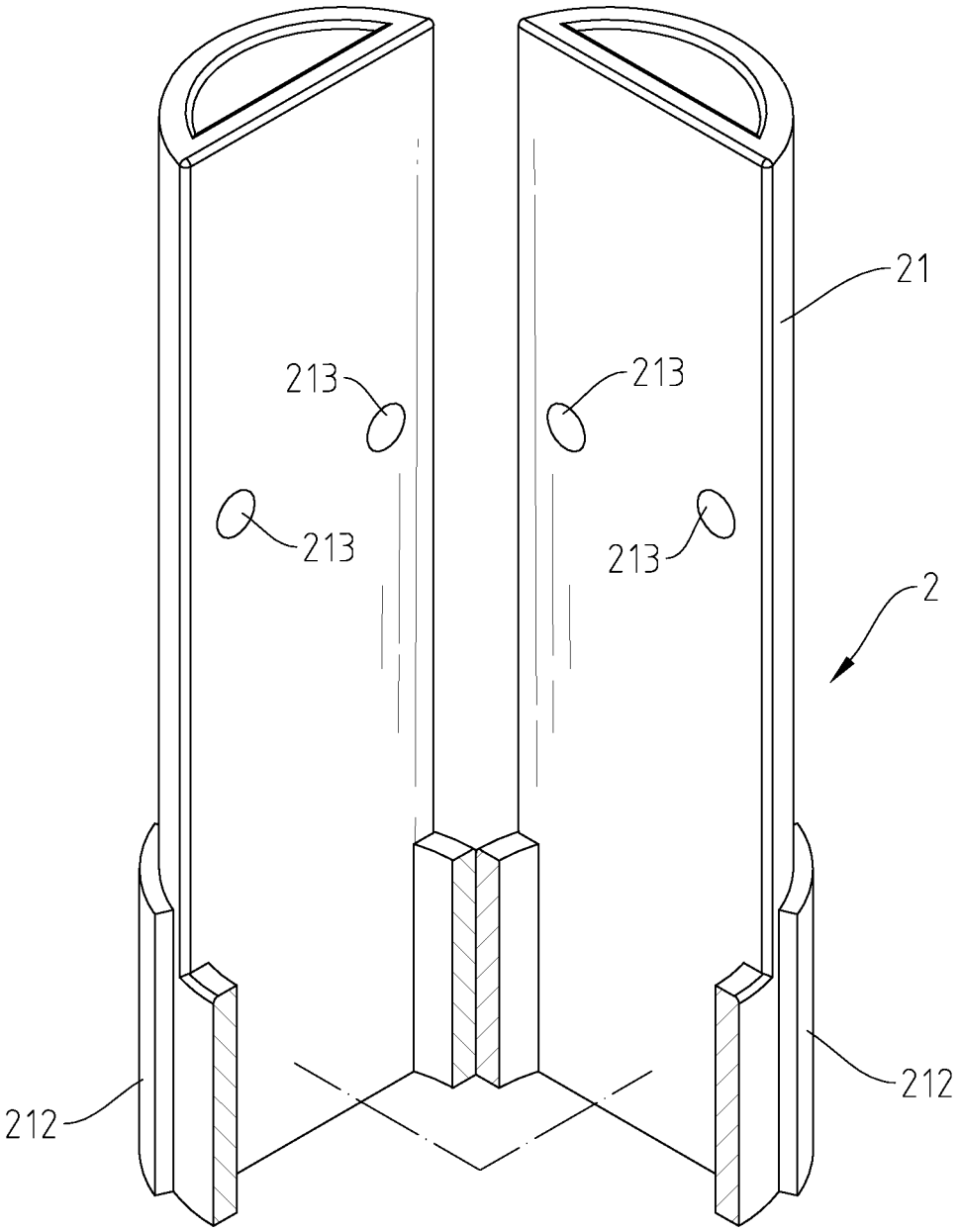
FIG. 4 is a sectional elevational view of a part of the movable mechanism of the positioning structure in accordance with the present invention.
Figure 5:
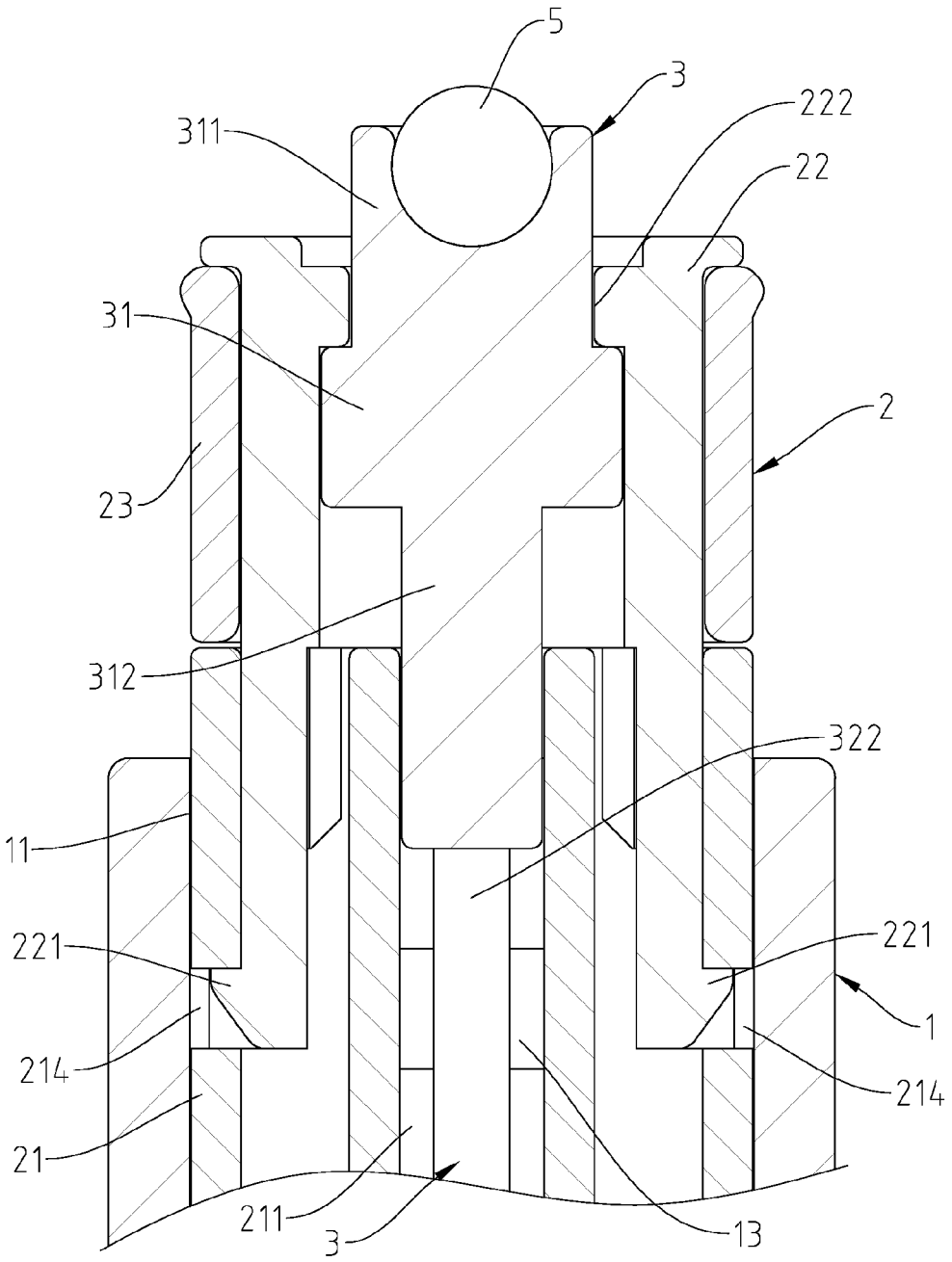
FIG. 5 is a sectional view of a part of the positioning structure in accordance with the present invention.
Figure 6:
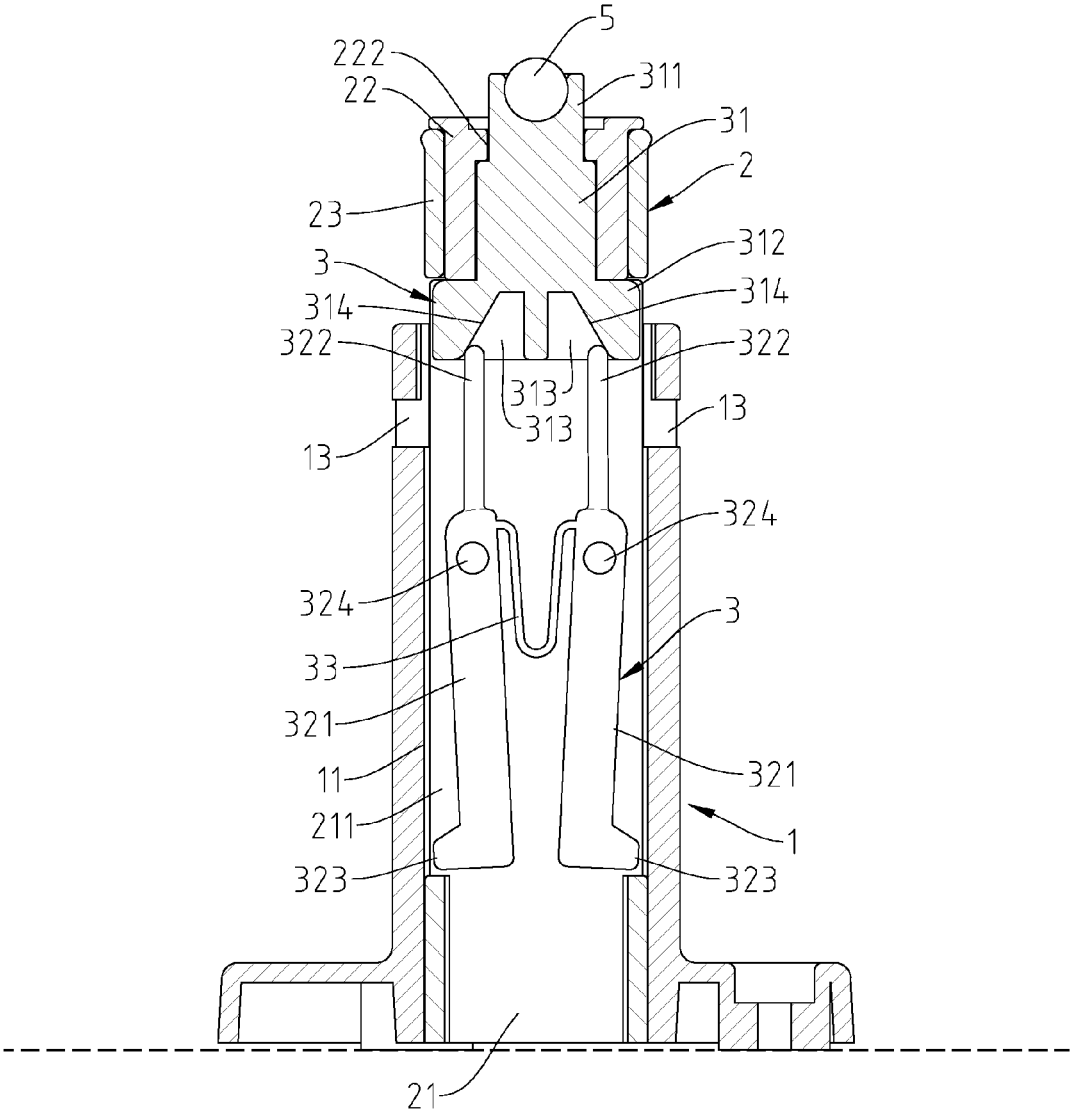
FIG. 6 is a schematic sectional view of the positioning structure in accordance with the present invention.
Figure 7:
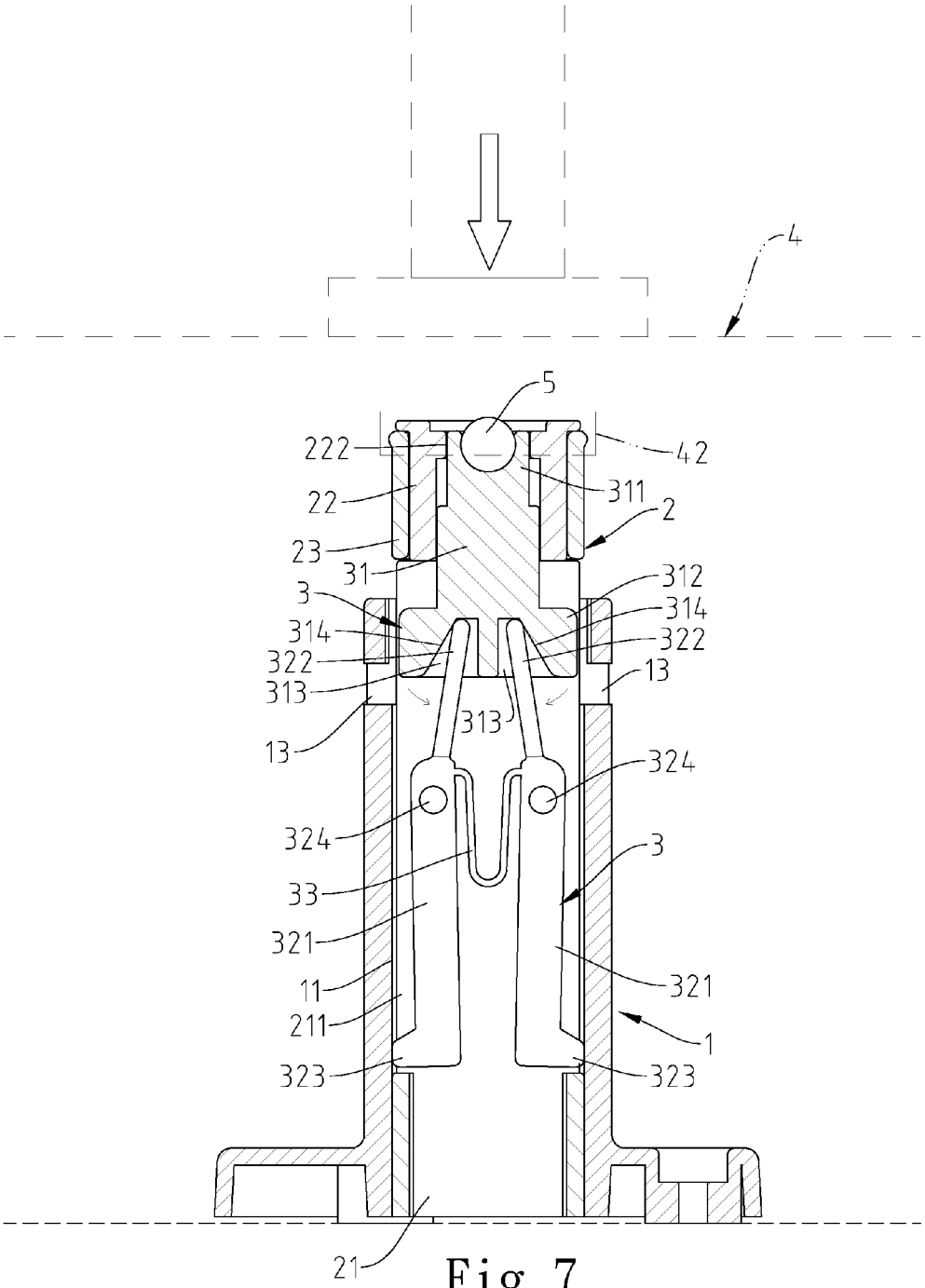
FIG. 7 is a schematic applied view of the positioning structure in accordance with the present invention (I).
Figure 8:
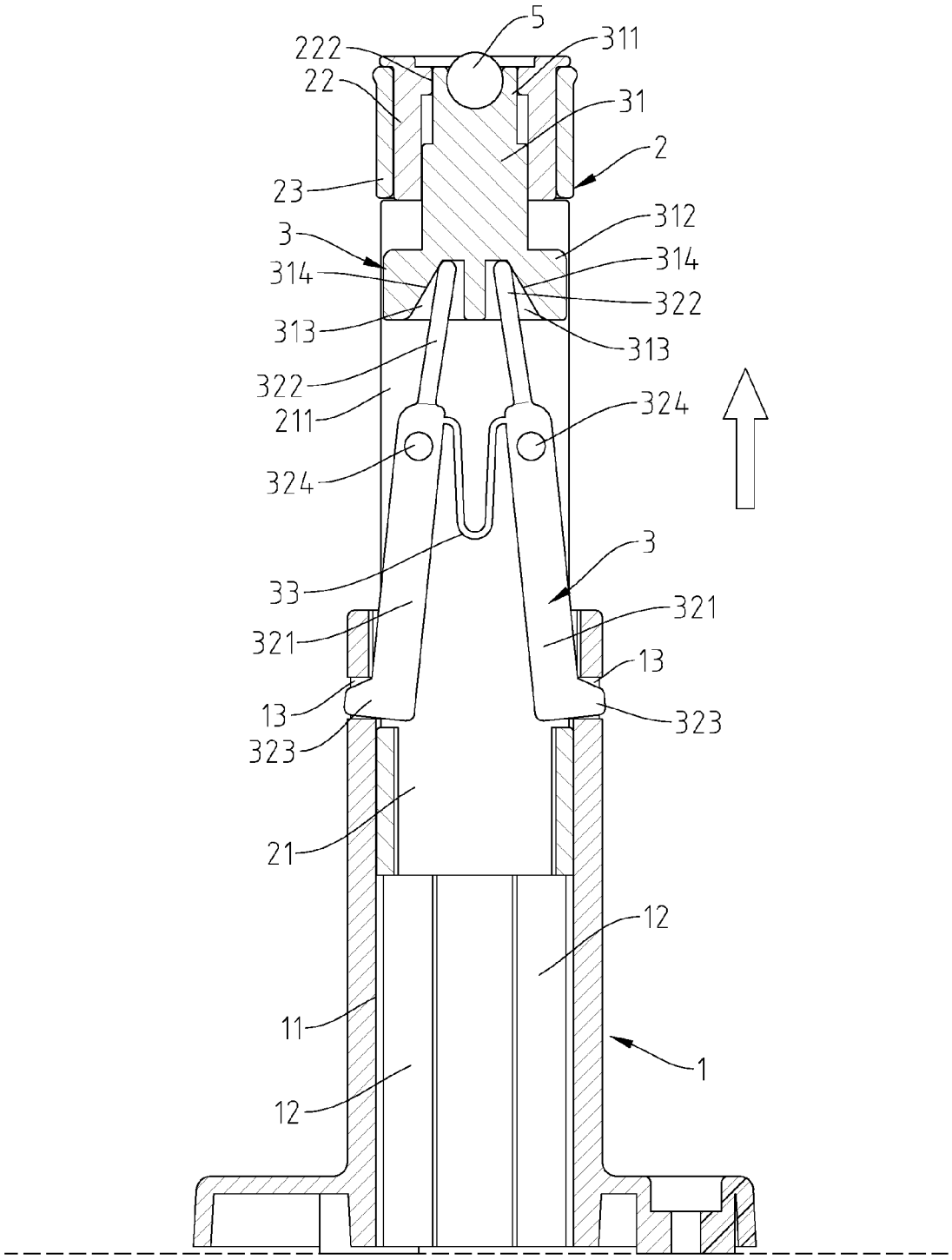
FIG. 8 is a schematic applied view of the positioning structure in accordance with the present invention (II).
Figure 9:
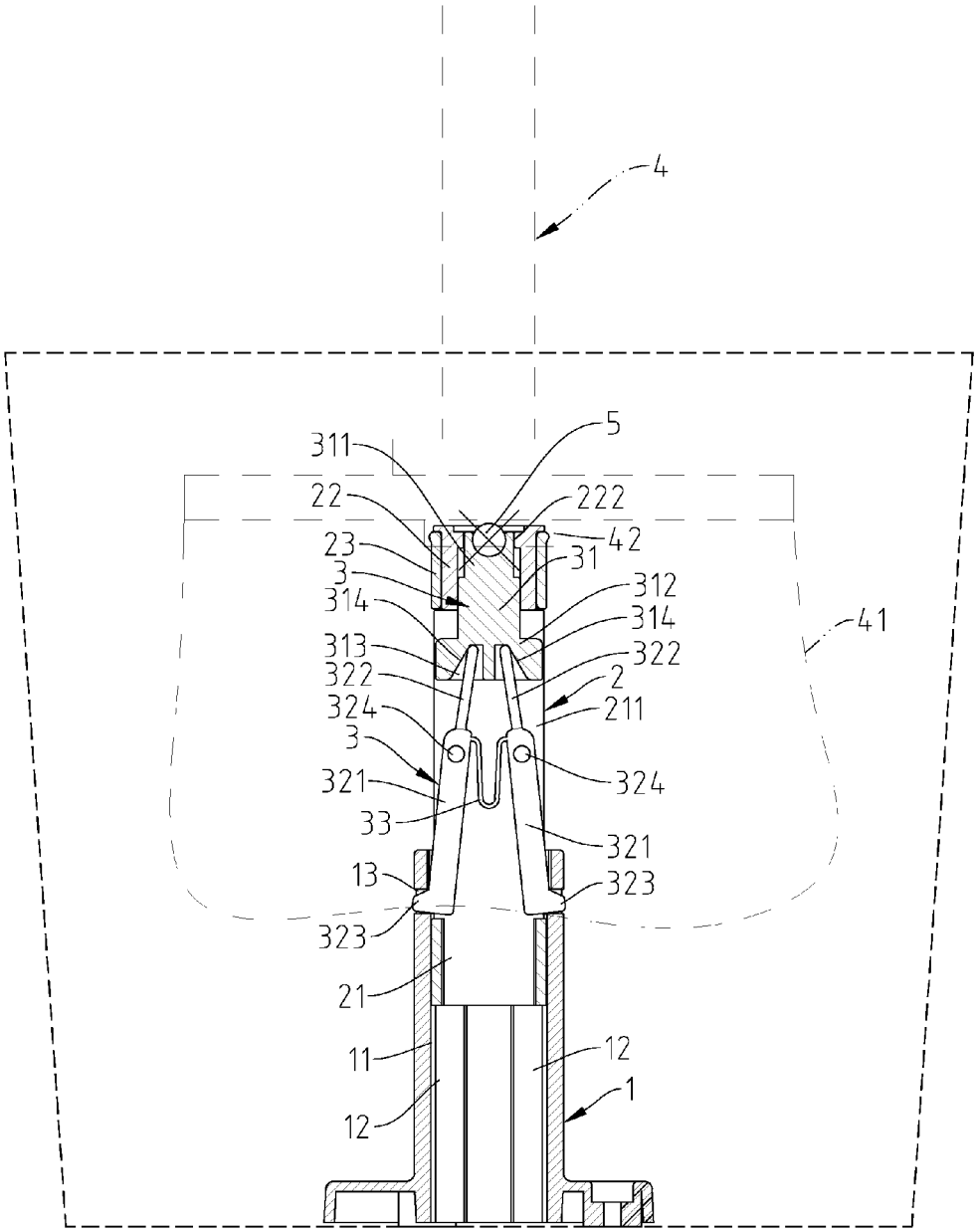
FIG. 9 is a schematic sectional view of the present invention, illustrating a connector of a mop connected to the collar of the positioning structure.

Referring to FIGS. 1-6, a positioning structure in accordance with the present invention is shown. The positioning structure comprises a locating member 1, a movable mechanism 2 and a positioning mechanism 3.

The locating member 1 comprises a displacement chamber 11, a plurality of sliding grooves 12 longitudinaly located on an inner perimeter thereof around the displacement chamber 11 and equiangularly spaced from one another, and two retaining holes 13 transversely cut through the peripheral wall thereof near the elevation of the top ends of the sliding grooves 12.

The movable mechanism 2 is axially slidably mounted in the displacement chamber 11 of the locating member 1, comprising a sliding member 21, a position-limiting member 22 and a collar 23. The position-limiting member 22 is connected to a top side of the sliding member 21. The sliding member 21 comprises an accommodation chamber 211, a plurality of pivot holes 213 transversely disposed in communication with the accommodation chamber 211, a plurality of sliding blocks 212 equiangularly spaced around the periphery thereof at a bottom side and respectively slidably coupled to the sliding grooves 12 of the locating member 1, and a plurality of locating holes 214 equiangularly spacede around the periphery. The position-limiting member 22 comprises a through hole 222 cut through opposing top and bottom ends thereof, and a plurality of hooked portions 221 extended from a bottom side thereof and equiangularly spaced from one another and respectively hooked in the locating holes 214 of the sliding member 21. The collar 23 is pivotally mounted around the position-limiting member 22.

The positioning mechanism 3 comprises an abutment member 31, two actuation members 32, and an elastic connection member 33. The abutment member 31 comprises two abutment portions 311 bilaterally disposed at a top side thereof, two guide portions 312 bilaterally disposed at an opposing bottom side thereof, two guide grooves 313 located on a bottom wall thereof, and a guide slope 314 located in each guide groove 313 and sloping upwardly inwardly toward the central axis thereof. The actuation members 32 are arranged in parallel, each comprising a body 321, a resilient arm 322 upwardly extended from a top end of the body 321, a protruding portion 323 perpendicularly extended from an opposing bottom end of the body 321, and two pivot pins 324 symmetrically located on two opposite sides of the body 321 near the resilient arm 322 and respectively pivotally coupled to respective pivot holes 213 of the movable mechanism 2. The elastic connection member 33 is connected between the bodies 321 of the two actuation members 32 to push the bodies 321 of the two actuation members 32 outwardly away from each other. The abutment member 31 is mounted in the through hole 222 of the position-limiting member 22 of the movable mechanism 2, allowing the abutment portion 311 to protrude over the topmost edge of the position-limiting member 22. The bodies 321 of the actuation members 32 are respectively pivotally mounted in the sliding member 21 to keep the respective resilient arms 322 below the guide portions 312 of the abutment member 31.

Referring to FIGS. 6-9, as illustrated, before connection of the collar 23 of the movable mechanism 2 to a mop 4, the bodiess 321 of the two actuation members 32 of the positioning mechanism 3 are forced apart by the elastic connection member 33, and the resilient arms 322 of the two actuation members 32 of the positioning mechanism 3 are respectively abutted against the guide slopes 314 in the respective guide grooves 313. At this time, the abutment portion 311 of the abutment member 31 protrudes over the topmost edge of the position-limiting member 22; the sliding member 21 of the movable mechanism 2 is received inside the displacement chamber 11 of the locating member 1. When the user is going to dehydrate the mop 4, connect the connector 42 (in the mop head 41) of the mop 4 to the collar 23 of the movable mechanism 2. At this time, the connector 42 of the mop 4 pushes the abutment portion 311 of the abutment member 31 backwardly to the inside of the position-limiting member 22 of the movable mechanism 2, causing the guide slopes 314 to force the respective resilient arms 322 inwardly into the deep inside of the respective guide grooves 313. When the mop 4 is moved upward, the position-limiting member 22 will be stopped by the collar 23, enabling the actuation members 32 to be moved upwards with the sliding member 21. When the actuation members 32 of the positioning mechanism 3 reach the elevation where the protruding portions 323 are respectively aimed at the respective retaining holes 13 of the locating member 1, the protruding portions 323 are forced out of the sliding member 21 of the movable mechanism 2 and engaged into the respective retaining holes 13 to lock the mop 4 in position for dehydration.

Figure 10:
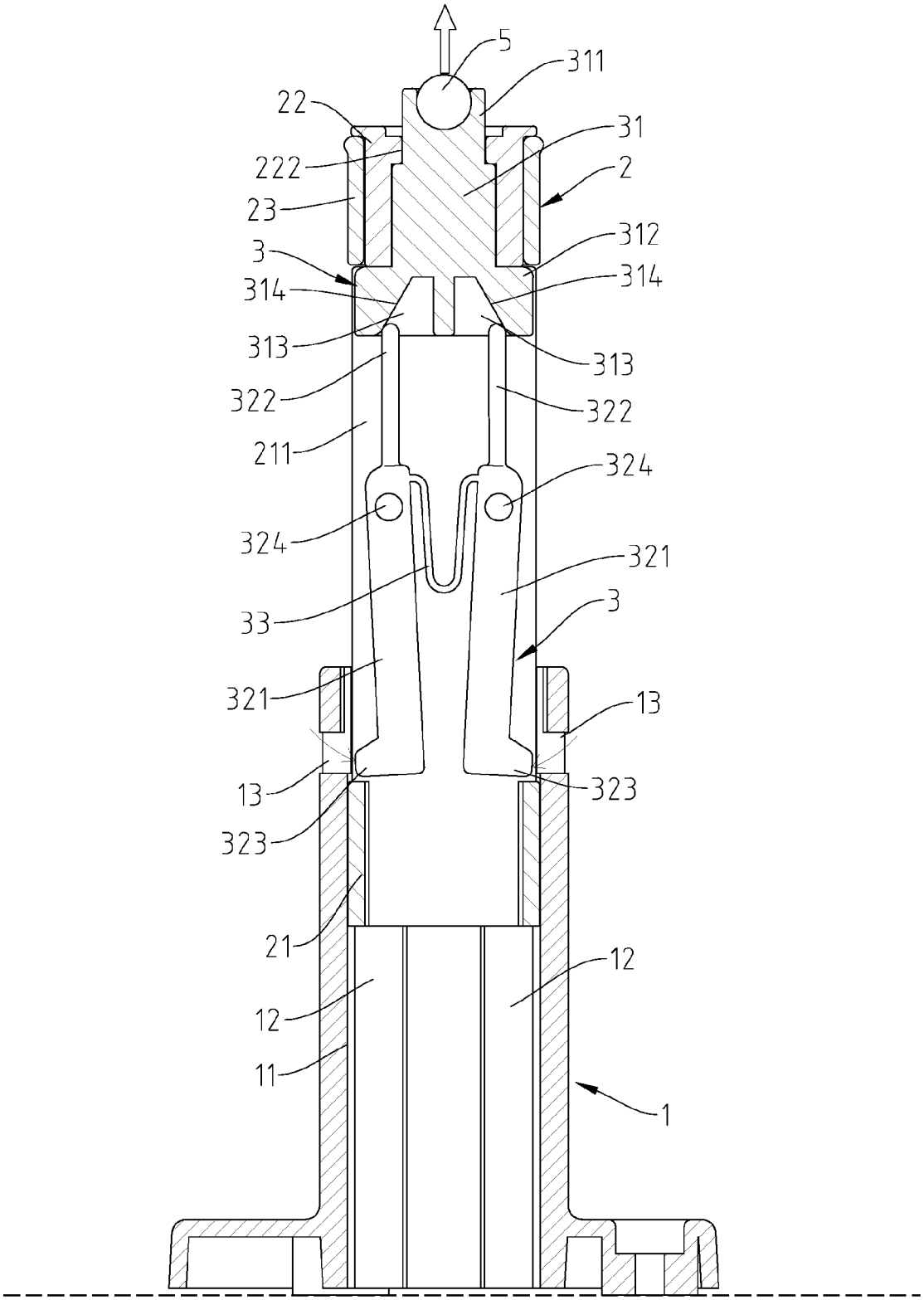
FIG. 10 is a schematic applied view of the positioning structure in accordance with the present invention (III).

Referring to FIG. 10 and FIGS. 6 and 7 again, as illustrated, when the connector 42 of the mop 4 is moved away from the abutment portion 311 of the positioning mechanism 3, the elastic connection member 33 of the positioning mechanism 3 will force the two resilient arms 322 toward each other, causing the protruding portions 323 to be disengaged from the respective retaining holes 13 and received inside the sliding member 21 for allowing the sliding member 21 to be freely moved in the displacement chamber 11.

Referring to FIG. 9 again, a rolling ball 5 is mounted in a top side of the abutment portion 311 of the positioning mechanism 3, facilitating rotation of the connector 42 of the mop 4.

What is claimed is:

1. A positioning structure, comprising a locating member, a movable mechanism and a positioning mechanism, said locating member comprising a displacement chamber and a plurality of retaining holes disposed in communication with said displacement chamber, said movable mechanism being mounted in said displacement chamber, said movable mechanism comprising a sliding member and a position-limiting member, said position-limiting member being connected to a top side of said sliding member, wherein:

said positioning mechanism comprises an abutment member and two actuation members, said abutment member comprising two abutment portions bilaterally disposed at a top side thereof, two guide portions bilaterally disposed at an opposing bottom side thereof and two guide grooves located on a bottom wall thereof, each said actuation member comprising a body, a resilient arm upwardly extended from said body and a protruding portion perpendicularly extended from an opposing bottom end of said body, said abutment member being mounted in said position-limiting member of said movable mechanism with said abutment portions respectively extended out of said position-limiting member, said body of each said actuation member being pivotally connected to said sliding member, said resilient arms of said two actuation members being disposed below said guide portion of said abutment member such that said abutment portion of said abutment member is received inside said position-limiting member and said protruding portions of said actuation members are respectively engaged into the respective said retaining holes of said locating member.

2. The positioning structure as claimed in claim 1, wherein said abutment member of said positioning mechanism further comprises a guide slope located in each said guide groove and sloping upwardly inwardly toward a central axis of said abutment member and adapted for abutting against said resilient arm of the respective one said actuation member and guiding said resilient arm of the respective one said actuation member toward an inside of the associated said guide groove when said abutment portion of said abutment member is received in said position-limiting member.

3. The positioning structure as claimed in claim 1, wherein said positioning mechanism further comprises an elastic connection member connected between said bodies of said two actuation members to force said two actuation members outwardly away from each other.

4. The positioning structure as claimed in claim 1, wherein said locating member further comprises a plurality of sliding grooves longitudinally located on an inner perimeter thereof around said displacement chamber and equiangularly spaced from one another; said sliding member of said movable mechanism comprises a plurality of sliding blocks respectively slidably coupled to said sliding grooves of said locating member.

5. The positioning structure as claimed in claim 1, wherein said sliding member of said movable mechanism comprises an accommodation chamber and a plurality of pivot holes transversely disposed in communication with said accommodation chamber; each said actuation member comprises two pivot pins symmetrically located on two opposite sides of the body thereof near the associated said resilient arm and respectively pivotally coupled to the respective said pivot holes of said sliding member of said movable mechanism.

6. The positioning structure as claimed in claim 1, wherein said sliding member comprises a plurality of locating holes equiangularly spaced around the periphery thereof; said position-limiting member of said movable mechanism comprises a through hole disposed through opposing top and bottom ends thereof, and a plurality of hooked portions extended from a bottom side thereof and equiangularly spaced from one another and respectively hooked in said locating holes of said sliding member; said movable mechanism further comprising a collar pivotally mounted around said position-limiting member.

* * * * *